US007026768B1

(12) United States Patent
Ruiz

(10) Patent No.: US 7,026,768 B1
(45) Date of Patent: Apr. 11, 2006

(54) APPARATUS FLASHING LIGHTS IN SEQUENCES INDICATING DIRECTIONS OF MOVEMENT IN RESPONSE TO DETECTED FIRE CONDITIONS AND IN RESPONSE TO AN ELECTRICAL POWER FAILURE

(76) Inventor: Carmelo C. Ruiz, 7550 Black Olive Way, Tamarac, FL (US) 33321

( * ) Notice: Subject to any disclaimer, the term of this patent is extended or adjusted under 35 U.S.C. 154(b) by 27 days.

(21) Appl. No.: 10/910,859

(22) Filed: Aug. 4, 2004

(51) Int. Cl.
*H05B 37/02* (2006.01)

(52) U.S. Cl. ..... 315/185 R; 315/193; 315/200 A

(58) Field of Classification Search ..... None
See application file for complete search history.

(56) References Cited

U.S. PATENT DOCUMENTS 3,789,211 A * 1/1974 Kramer ..... 362/231
3,869,639 A 3/1975 Herzog
3,916,404 A 10/1975 Gouge
3,969,720 A 7/1976 Nishino
4,199,754 A 4/1980 Johnson et al.
4,347,499 A 8/1982 Burkman, Sr. et al.
4,422,069 A 12/1983 Edstrom et al.
4,531,114 A 7/1985 Topol et al.
4,801,928 A 1/1989 Minter
5,027,037 A * 6/1991 Wei ..... 315/200 A
5,886,620 A 3/1999 Stewart et al.
6,049,178 A 4/2000 Sheu et al.
6,249,221 B1 6/2001 Reed

* cited by examiner

*Primary Examiner*—David Vu
(74) *Attorney, Agent, or Firm*—Ronald V. Davidge

(57) ABSTRACT

A direction-indicating device includes a control unit, which is plugged into an external power source, and a number of interconnected lights, extending in a first direction. When the external power source fails, the lights are flashed, using power from a battery in the control unit, in a sequence indicating a preferred direction of movement. The control unit may also charge the battery from the external power source, and the lights may additionally be flashed in response to a signal indicating that fire conditions exist. The direction indicated by the lights may be reversed, based on a combination of alarm units transmitting fire detection signals.

25 Claims, 9 Drawing Sheets

FIG. 2

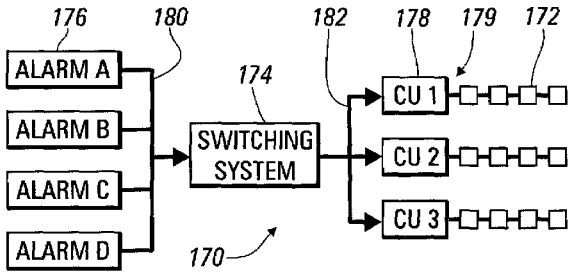
FIG. 6
| COUNTER OUTPUT | FIRST SEQUENCE | SECOND SEQUENCE |
|---|---|---|
| C1 | L1 | L1 |
| C2 | L2 | L4 |
| C3 | L3 | L3 |
| C4 | L4 | L2 |
| C1 | L1 | L1 |
186 166 190
FIG. 7
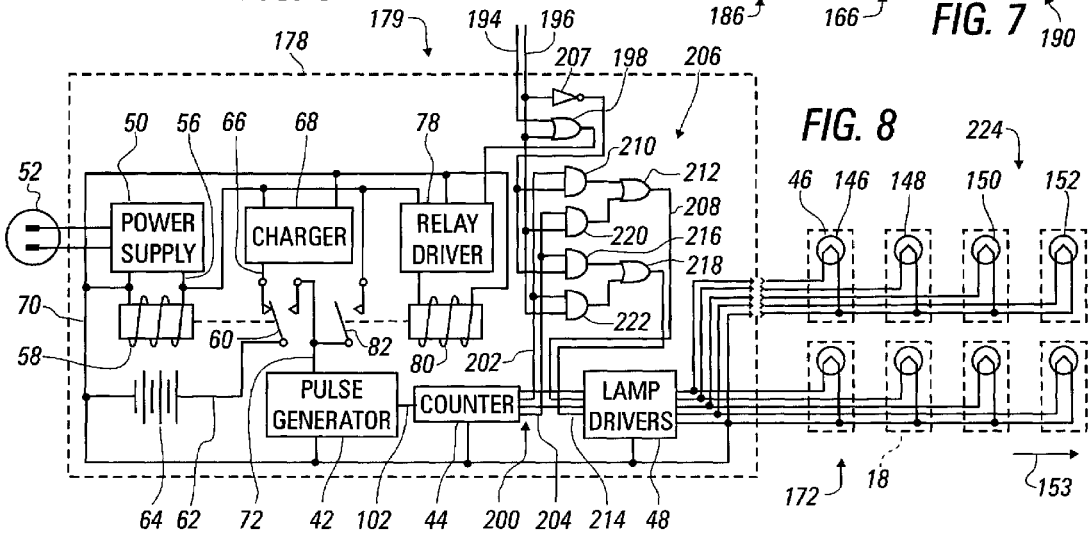
FIG. 8

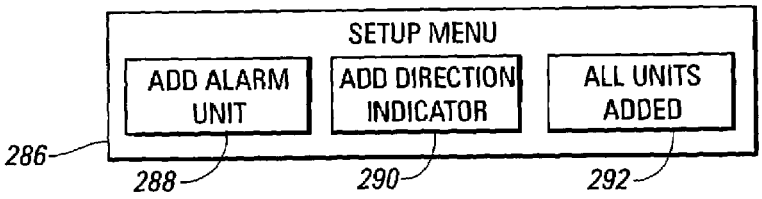
FIG. 15
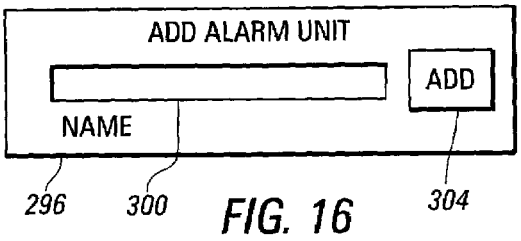
FIG. 16
274
| ID | NAME |
|---|---|
| 0001 | KITCHEN |
| 0010 | STAIRWELL |
| 0100 | 1ST BEDROOM |
| 1000 | 2ND BEDROOM |
310 312 314
FIG. 17
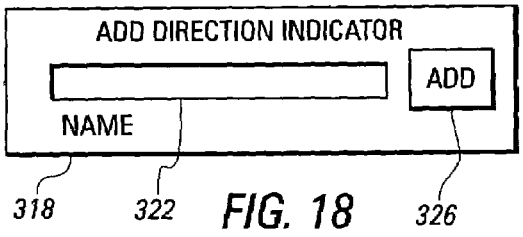
FIG. 18
276
| ID | NAME |
|---|---|
| 001 | DOWNSTAIRS HALL |
| 010 | STAIRWELL |
| 011 | UPSTAIRS HALL |
332 334 336
FIG. 19
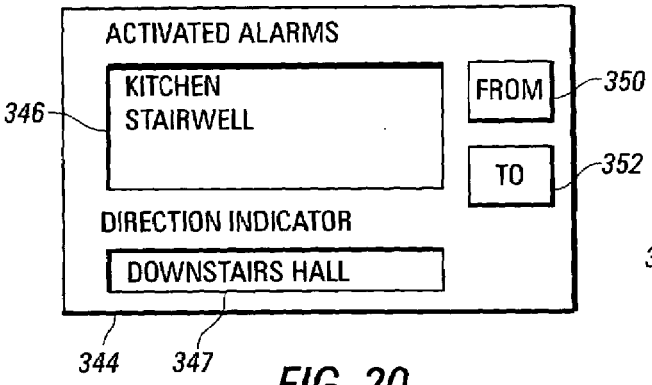
FIG. 20
278
| ID | 001 | 010 | 011 |
|---|---|---|---|
| 0001 | 0 | 0 | 0 |
| 0010 | 1 | 1 | 0 |
| 0011 | 0 | 0 | 1 |
| 0100 | 1 | 1 | 1 |
| 0101 | 0 | 0 | 0 |
356 358 360
FIG. 21

APPARATUS FLASHING LIGHTS IN SEQUENCES INDICATING DIRECTIONS OF MOVEMENT IN RESPONSE TO DETECTED FIRE CONDITIONS AND IN RESPONSE TO AN ELECTRICAL POWER FAILURE

BACKGROUND OF THE INVENTION

1. Field of the Invention

This invention relates to apparatus actuated to provide an indication of a direction of movement during an electrical power failure or during a fire emergency.

2. Summary of the Background Information

A number of patents describe methods for actuating lights indicating a direction of movement for personnel when a fire has been detected. For example, U.S. Pat. No. 3,969,720 describes a fire alarm, a plurality of indicator lights arranged in a line toward an emergency exit, and an operating unit, coupled to the alarm, being operable in response to an output signal in from the alarm to successively energize the indicator units in the direction of the exit. Each of the indicator units includes a light and a buzzer. U.S. Pat. No. 4,801,928 describes a system including an indicator unit having at least three electroluminescent lamps in a linear arrangement and circuitry for sequentially illuminating the lamps in a repeated manner from one end of the arrangement to the other. The electronic circuitry is also provided to sequentially illuminate a group of electroluminescent lamps in one direction in response to in one direction in response to a first sensed condition of relative danger and in another direction in response to a second sensed condition of relative danger. For example, a smoke detector is placed near each of two exits, with the lights being activated upon the detection of smoke to cause movement toward the exit at which smoke is not detected. What is needed is a system in which the same arrangement of lights can be flashed in different sequences to indicate different directions of movement.

Modern airliners include strips of lights extending in rows along the floor, with means being provided to flash the lights in sequences indicating the available paths for escape in the event of an aircraft fire. A system of this type is described in U.S. Pat. No. 4,347,499, with the operation of the sequentially flashed lights being responsive to sensing means determining the availability of an exit for use. The lights of such systems are mounted in slots extending along the floor. What is needed in for fire protection within a building is a modular system including units flashing lights to indicate a desired direction of movement that can easily be installed wherever electrical service is provided.

Other patents describe apparatus providing for different types of lighting indications upon the detection of a fire. For example, U.S. Pat. No. 6,249,221 describes an escape system for helping a person find an exit door during an emergency providing limited visibility. The system includes at least one heat detector, at least one smoke detector, an audible alarm circuit, a dynamic pulsating door base light, and, optionally, an additional continuous door base light. U.S. Pat. No. 4,531,114 describes an alarm system including exit sign units coupled to a smoke sensor and a heat sensor for input information and to a speech synthesizer and a strobe light for providing output information. A communication unit provides communication coupling between sign units on a single floor and between interfaces between floors and a central monitoring unit. U.S. Pat. No. 5,996,620 describes a building fire alarm system including a network of light strobes arranged to flash simultaneously.

Other patents describe alarm systems including apparatus for providing back-up electrical power in the event of a power failure, with the back-up power being used to maintain operation of devices for detecting and indicating dangerous conditions. For example, U.S. Pat. No. 3,916,404 describes a personnel protection system including a danger detecting system, such as a thermally operated electronic controller covering an area under protection, a distinctive audible alarm system, and visual directing means indicating the location of one or more exits and the direction in which a suitable exit lies. An auxiliary electric power supply system stands in reserve to operate the detector circuits, a flashing light circuit, and warning sound circuits from a storage battery. U.S. Pat. No. 4,199,734 describes a home security system including a fire detector, an audible alarm, and a battery for operation in the event of a power failure. The system also provides emergency lighting during a power failure, with the lighting being turned off if the battery voltage gets too low so that the alarm function can be maintained.

U.S. Pat. No. 4,422,069 describes a system including at least one, and preferably two, flashable lights positioned near an exit door to be activated in case of an emergency, such as a fire or interruption of power. The lights are preferably located near the floor on opposite sides of the exit and are energized by emergency power supply batteries upon interruption of the main power supply, which may be interrupted by a fire detection device.

Other patents describe apparatus providing illumination in the event of a power failure without provisions for a fire alarm. For example, U.S. Pat. No. 3,869,639 describes a circuit for driving at least one gaseous discharge lamp from alternating current during normal conditions and from a battery during a power failure. U.S. Pat. No. 6,049,178 describes a circuit for maintaining illumination of an emergency exit light during a power failure. What is needed is a system providing indication of a preferred direction of movement in the event of a power failure.

SUMMARY OF THE INVENTION

It is a first objective of the invention to provide a fire protection system including a number of direction indicating units, each of which includes a light arrangement that can be flashed in either of two sequences to indicate movement in either of two directions.

It is another objective of the invention to provide such a fire protection system having an additional capability of flashing lights to indicate a direction of movement in the event of a power failure;

It is yet another objective of the invention to provide such a fire protection system having an ability to easily install modular direction indicators where needed within a building;

It is still another objective of the invention to provide such a fire protection system with an ability to operate various direction indicators to show a direction of movement according to the combination of alarm devices indicating fire conditions.

In accordance with a first aspect of the invention, apparatus is provided including a first arrangement of light units and a control unit. The first arrangement of light units includes a first plurality of electrically interconnected light units, each of which includes a lamp. The first plurality of light units extends in a first direction from a first light unit at a first end of the first plurality of light units to a last light unit at an end of the of the first plurality of light units opposite the first end. The control unit includes a battery, a plug for attachment to an external electrical power source, a first switching circuit, and a lamp circuit. The lamp circuit is electrically connected to the battery by the first switching circuit in response to termination of a flow of electrical current through the plug from the external power source to illuminate all light units within the first plurality in a sequence, in which each light unit disposed between the first light unit and the last light unit is illuminated after a light unit adjacently disposed opposite the first direction is illuminated and before a light unit adjacently disposed in the first direction is illuminated.

The lamp circuit may additionally include a second switching circuit connecting the lamp circuit to a source of electrical current in response to an external fire detection signal. Several such control units attached to several such light arrangements may be included in a system, along with a fire detection device generating the fire detection signal in the event of a fire.

According to another aspect of the invention, a system is provided including a number of alarm units, a number of arrangements of light units, a number of control units, and a switching system. Each of the alarm units produces a fire detection signal in response to detecting a fire condition. Each of the arrangements of light units includes a first plurality of electrically interconnected light units, each including a lamp, with the first plurality of light units extending in a first direction from a first light unit at a first end of the first plurality of light units to a last light unit and an end of the first plurality of light units opposite the first end. Each of the control units includes a circuit illuminating all light units within the first plurality in a first sequence in response to an alarm signal of a first type. In the first sequence, each light unit disposed between the first light unit and the last light unit is illuminated after a light unit adjacently disposed opposite the first direction is illuminated and before a light unit adjacently disposed in the first direction is illuminated. The circuit within at least one of the control units additionally illuminates all light units within the first plurality in a second sequence in response to an alarm signal of a second type. In the second sequence, each light unit disposed between the first light unit and the last light unit is illuminated after a light unit adjacently disposed in the first direction is illuminated and before a light unit adjacently disposed opposite the first direction is illuminated. The switching system receives the fire detection signals from the plurality of alarm units and transmits alarm signals to the control units within the plurality of control units. The alarm signal transmitted to at least one of the control units is of the first type, or of the second type, depending on a combination of the control units producing the fire detection signals.

The switching system may include at least one switching unit, having an input terminal, a circuit generating a number of switch input signals, and a number of switches. The input terminal reveives a fire detection signal from each of the alarm units. The circuit generates a switch input corresponding to each combination within a number of combinations of fire detection signals. Each of the switches, which is connected to receive one of the switch input signals, is switchable between a first position and a second position. An input signal of the first type is generated for transmission to a control unit from a switch input signal with the switch in the first portion, and an input signal of the second type is generated for transmission to the control unit from a switch input signal with the switch in the second position.

Alternately, the switching system may include a computer system having at least one input port, at least one output port, storage, and a microprocessor. The input port receives fire detection signals from a number of alarm units. The output port transmits an alarm signal to at least one of the control units. The storage stores a data structure including a data record for each combination of the alarm units in a plurality of combinations of the alarm units, wherein each of the data records includes a code for at least one of the control units indicating whether an alarm signal of a first type or an alarm signal of a second type is to be sent to the control unit. The microprocessor is programmed to perform steps of receiving a fire detection signal from at least one of the alarm units; finding a data record in the data structure corresponding to a combination of the alarm units transmitting the fire detection signal; transmitting the alarm signal of the first type to at least one of the control units in response to finding a code in the data record indicating that the alarm signal of the first type is to be transmitted to the control unit; and transmitting the alarm signal of the second type to at least one of the control units in response to finding a code in the data record indicating that the alarm signal of the second type is to be transmitted to the control unit.

BRIEF DESCRIPTION OF THE DRAWINGS

FIG. 6 is a block diagram of a fire protection system built according to an alternative embodiment of the invention, including a number of assemblies of flashing lights, each indicating the safer of two directions of movement;

FIG. 7 is a tabular view of two sequences of operation of flashing lights within the fire protection system of FIG. 6, indicating each of two directions of movement;

FIG. 8 is a schematic view of a direction indicator within fire protection system of FIG. 6;

FIG. 15 is a display view of a setup menu displayed during execution of the setup subroutine of FIG. 14;

FIG. 16 is a display view of a text box displayed during execution of the setup subroutine of FIG. 14 for adding data describing an alarm unit within the fire protection system of FIG. 6;

FIG. 17 is a pictographic view of an alarm data structure generated during execution of the setup subroutine of FIG. 14;

FIG. 18 is a display view of a text box displayed during execution of the setup subroutine of FIG. 14 for adding data describing a direction indicator within the fire protection system of FIG. 6;

FIG. 19 is a pictographic view of a direction indicator data structure generated during execution of the setup subroutine of FIG. 14;

FIG. 20 is a display view of an activated alarms list box displayed during execution of the setup subroutine of FIG. 14 for adding data indicating the direction of motion to be displayed within each direction indicator for each combination of alarm systems providing alarm signals;

FIG. 21 is a pictographic view of a system data structure generated during execution of the setup subroutine of FIG. 14.

DETAILED DESCRIPTION OF THE INVENTION

Figure 1:
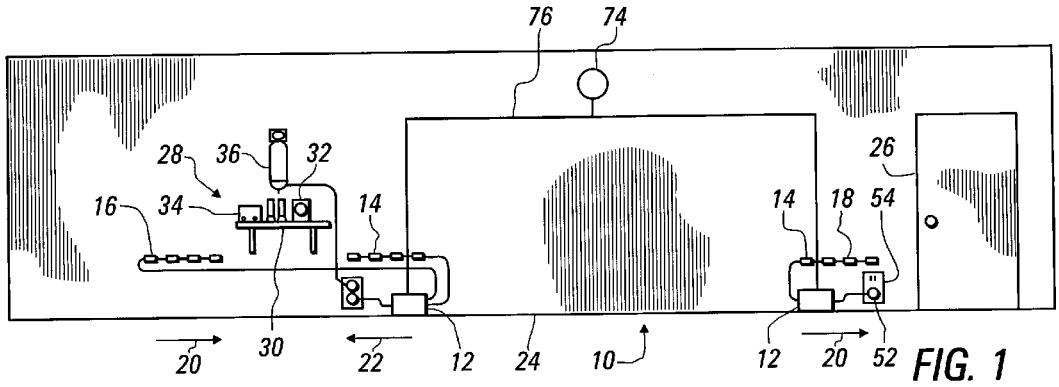
FIG. 1 is an elevation of a system including a number of devices including direction indicating flashing lights built in accordance with the invention.

FIG. 1 is an elevation of a system 10 including two control units 12 built in accordance with the invention, along with associated light arrangements 14,16 including individual interconnected light units 18 in which lamps are sequentially flashed to indicate a desired direction of movement, in the direction indicated by an adjacent arrow 20, 22.

As shown in the example of FIG. 1, the light arrangements 14, 16 may be installed within a building 24 to indicate directions of movement toward an exit door 26 and toward a location 28 where supplies useful in a power failure or in the event of a fire are provided. For example, such supplies include flashlights 30, an electric lantern 32, a battery-powered radio 34, and a unit 36 holding a supply of breathable gas that can be removed and carried to aid in an escape from a fire. The unit 36 may be built in accordance with copending U.S. patent application Ser. No. 10/382,304, filed Mar. 5, 2003, having a common inventor with the present invention, the disclosure of which is herein incorporated by reference, to include a light that is turned on in response to a power failure.

Figure 2:
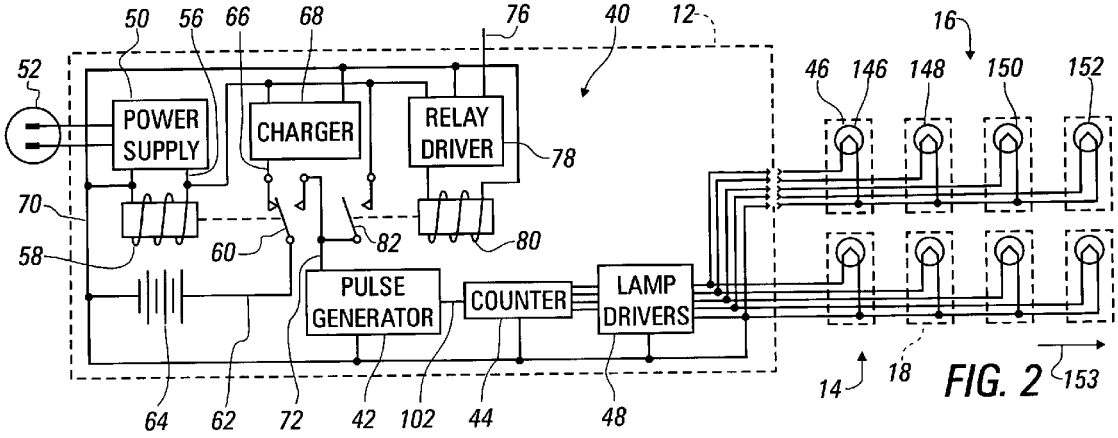
FIG. 2 is a schematic view of a control unit and associated assemblies of flashing lights within the system of FIG. 1.

FIG. 2 is a schematic view of the control unit 12, together with associated light arrangements 14, 16. The control unit 12 includes a lamp circuit 40 having a pulse generator 42 providing an input signal to a counter 44 in the form of a sequence of pulses. The counter 44 counts pulses from the pulse generator 42 and generates a number of output signals sequentially driving the individual lamps 46 within lighting units 18 through a number of lamp drivers 48.

The control unit 12 additionally includes a power supply 50 connected to a plug 52, which is in turn connected for operation to an external power source through a wall socket 54 (shown in FIG. 1). The power supply 50 is, for example, a conventional device producing one or more DC outputs, of which an output supplied on terminal 56 is exemplary, from an AC input provided by the external power source. While power is being provided through the plug 52, the power supply output on terminal 56, applied through a relay coil 58, holds an associated relay contact 60 in place so that a terminal 62 of a rechargeable battery 64 within the control unit 12 is connected to an output terminal 66 of a battery charger 68, with a connection between the opposite side of the battery 64 and the battery charger 68 being maintained through a ground line 70. The battery charger 68 includes conventional circuits for maintaining the rechargeable battery 64 in a charged condition by providing a controlled flow of current through the battery 64 from the power supply 50. In the event of a failure of the external power source, current stops flowing through the 52 into the power supply 50 and from the power supply 50 through the relay coil 58, so that the associated relay contact 60 transfers the connection to the battery terminal 62 to an input terminal 72 of the lamp circuit 40, causing the pulse generator 42 to begin generating pulses used to drive the lamps 46 sequentially.

Referring again to FIG. 1 and continuing to refer to FIG. 2, in accordance with one version of the invention, the system 10 additionally includes a fire detector 74, which may be a smoke detector, a temperature sensor, or a combination of such devices. In the event that conditions associated with a fire are detected, the fire detector 74 transmits a signal along a signal channel 76 to a relay driver circuit 78 within the lamp circuit 40. Upon receiving such a signal from the signal channel 76, the relay driver circuit 78 drives current through a relay coil 80, causing an associated relay contact 82 to connect the input terminal 72 of the lamp circuit 40 to the power supply output terminal 56, so that the pulse generator 42 generates pulses used to sequentially operate the lamps 46. In the event of a failure of the external power source to which the plug 52 is connected, during the sensing of a fire by the fire detector 74, the output voltage on power supply terminal 56 will fail, but the lamps will continue to flash, with the input terminal 72 of the lamp circuit 40 being connected to the battery terminal 62 by the relay contact 60.

The signal channel 76 may comprise a wire physically connecting a fire detector 74 to the control units 12, or a wireless signal channel, with the relay driver 78 including a wireless receiver triggered by receiving a signal generated by operation of the fire detector 74.

While relay coils 58, 80 and associated contacts 60, 82 have been described, it is understood that such components may be readily replaced by electronic switching devices as understood by individuals skilled in the art of circuit design. In general, the control unit 12 includes a first switching circuit, of which the relay including coil 58 and contact 60 are exemplary, connecting the lamp circuit 40 to the rechargeable battery 64 in response to termination of the flow of electrical current from the external power source through the plug 52, which stops the flow of current through the relay coil 58, so that the contact 60 transfers to connect the input terminal 72 to the battery 64. Furthermore, the lamp circuit 40 additionally includes a second switching circuit, of which the relay including coil 80 and contact 82 are exemplary, connecting the lamp circuit 40 to a source of electrical current from the power supply 50 in response to an external fire detection signal.

The apparatus of the invention can be used to indicate an exit direction or the direction in which flashlights, etc. are to be found without connection to a fire detector. Furthermore, an alternative version of the invention provides for operation in the event of a power failure without providing means for receiving a signal from a fire detector. In this alternative version, the signal channel 76, relay driver 78, relay coil 80, and associated relay contact 82 are eliminated, with the input terminal 72 of the lamp circuit 40 being only connected to the rechargeable battery 64 in the event of an electrical power failure.

Figure 3:
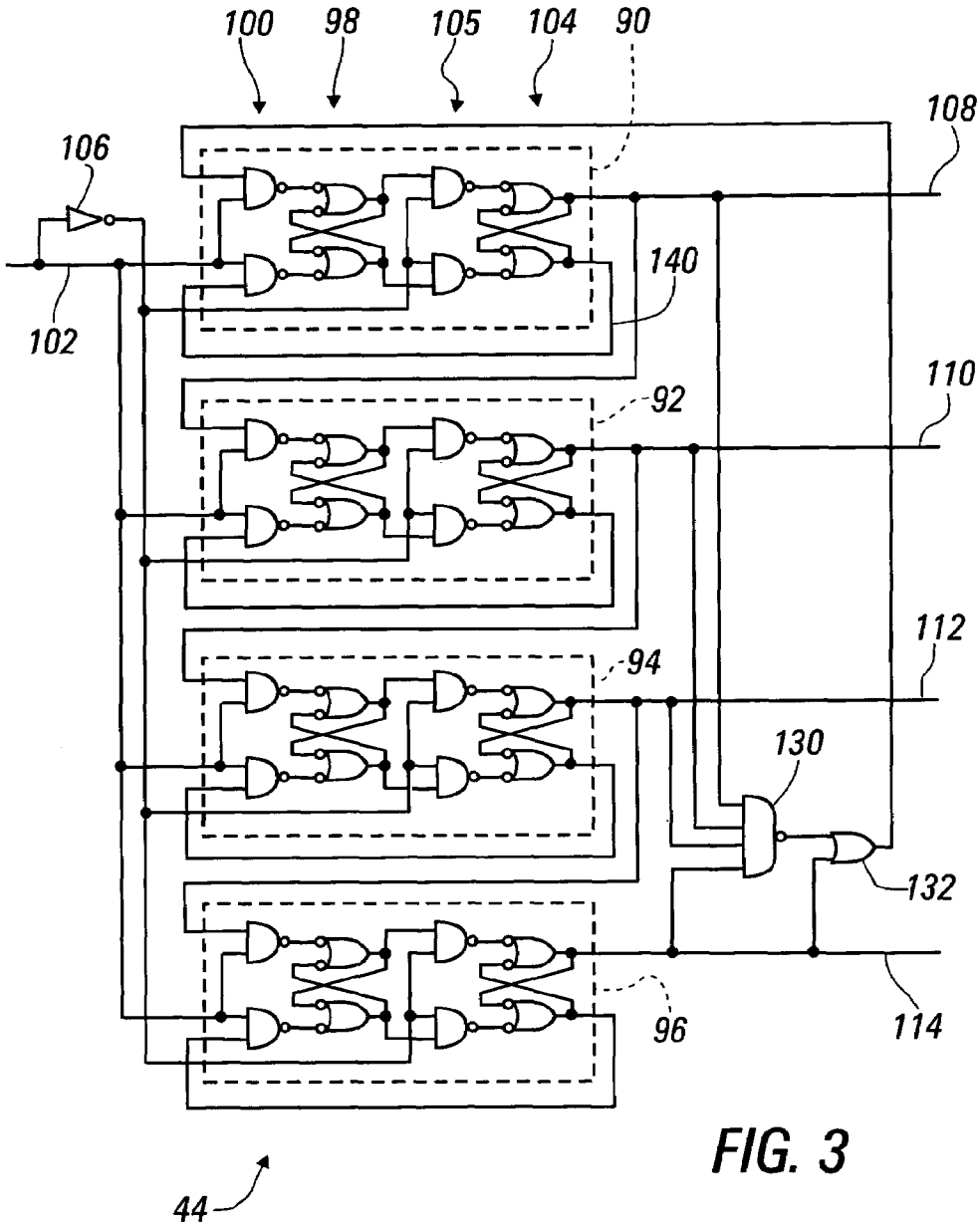
FIG. 3 is a schematic view of a counter for counting pulses within each a control unit in a device of FIG. 1.

The operation of the counter 44 to generate signals used to drive the lamps 46 will now be discussed, with particular reference being made to FIGS. 3 and 4. FIG. 3 is a schematic view of the counter 44 counting pulses from the pulse generator 42 within the lamp circuit 40 to generate signals for driving the lamps 46 in the desired sequence, while FIG. 4 is a graphical view of the pulses from the pulse generator 42 and of the resulting signals generated by the counter 44, with signal voltage levels being displayed along a vertical axis 86, and with time being displayed along a horizontal axis 88.

The counter 44 includes four flip-flops 90, 92, 94, 96, each of which is a master-slave type, having a master section 98 that is set or reset according to the outputs of NAND gates 100 when the pulse signal from the pulse generator 42, transmitted along line 102, is driven to a high state. Each of these flip-flops 90, 92, 94, 96 additionally has a slave section 104 that is then set or reset according to the outputs of NAND gates 105 when the pulse signal transmitted along line 102 is driven to a low state, with the slave section 104 being set or reset to match the conditions of the master section 98. This sequential process of setting or resetting first the master section 98 and then the slave Section 104 is brought about by providing the pulse signal from line 102 as an input to each of the master Section 98 and an inverse of this pulse signal, generated within an inverter 106 as an input to each of the slave section 104. Each of the four flip-flops 90, 92, 94, 96 provides an output signal at an output line 108, 110, 112, 114, respectively, which is generated by the output of one of the slave section 104.

Figure 4:
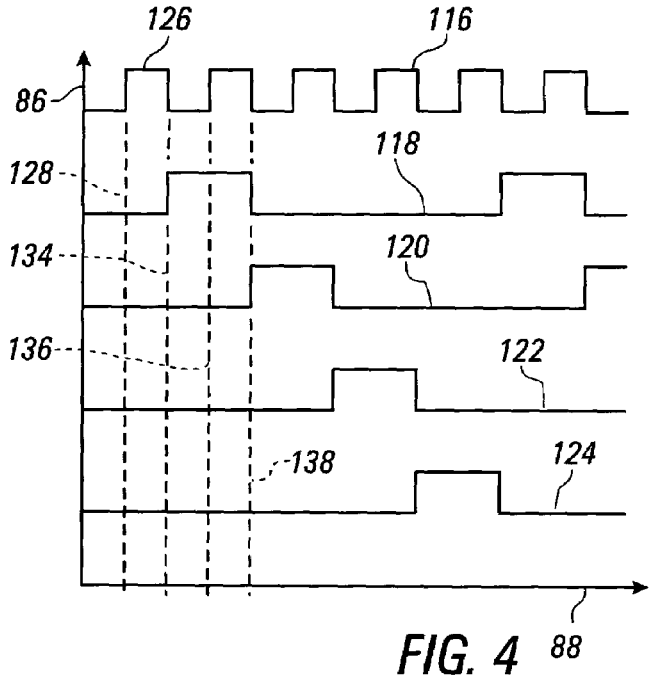
FIG. 4 is a graphical view of pulses generated within the control unit in a device of FIG. 1 and of lamp pulsing signals generated by the counter of FIG. 3.

FIG. 4 shows the timing relationships among the pulse signal 116 on line 102, a first output signal 118 on the first output line 108, a second output signal 120 on the second output line 110, a third output signal 122 on the third output line 112, and a fourth output signal 124 on the fourth output line 114. The process of generating the output signals 118, 120, 122, and 124 begins with a first pulse 126, which is generated in response to the application of a voltage to the input terminal 72 of the lamp circuit 40 (shown in FIG. 2). At the first time 128, when this first pulse 126 is driven high, the output signals 118, 120, 122, and 124 are all low, so that the output signals from an initializing NAND gate 130 and the OR gate 132 are each driven high, causing the master section 98 of the first flip-flop 90 to be set. However, the first output signal 118 remains low until a second time 136, when the pulse signal 116 is driven low, so that the slave section 104 are set or reset according to the levels of the master section 98 within the first flip-flop 90, with the first output signal 116 being driven high.

Then, at a third time 136, the pulse signal 116 is again driven high, so that the master section 98 of the second flip-flop 92 are driven into a set condition by the first output signal 118. However, the second output signal 120 remains at a low level until the pulse signal 116 is driven low at a fourth time 136, causing the slave section 104 of the second flip-flop 92 to be set according to the condition of the master section 98 of this flip-flop 92. At this fourth time 138, the second output signal 120 is driven high.

Additionally, at the third time 136, as the pulse signal 116 is driven high, the master section 98 of the first flip-flop 90 are driven to a reset condition by a signal on a reset line 140, which, being the inverse of the first output signal 118, is low at this time. Then, at the fourth time 138, when the pulse signal 116 is again driven low, the slave section 104 of the first flip-flop 90 are driven into a reset condition to match the condition of the master section 98 of this flip-flop 90, causing the first output signal 118 to be driven low.

The preceding discussion has described the generation of single pulses in the first output signal 118 and in the second output signal 120. Since the third flip-flop 84 is connected to the second flip-flop 92 in the manner with which the second flip-flop 92 is connected to the first flip flop 90, and since the fourth flip-flop 96 is similarly connected to the third flip-flop 94, pulses are similarly generated in a sequential manner within the third and fourth output signals 122, 124. Furthermore, since the second, third, and fourth flip-flops 92, 94, 96 are each provided with reset lines 140 in the manner of the first flip-flop 90, the individual pulses within the second, third, and fourth output signals 120, 122, 124 are terminated in the manner described above for the individual pulse 142 of the first output signal 118. The fourth output signal 124, on line 114 is connected to one of the NAND gates 100 of the first flip-flop 90, so that a pulse within the fourth output signal 124 is followed by a pulse within the first output signal 118.

Referring additionally to FIG. 2, generation of the pattern of sequential pulses on the output lines 108, 110, 112, 114 continues as long as an electrical voltage is applied to the lamp circuit 40 through the input terminal 82. Each of the light arrangements 14, 16 includes a first lamp 146 that is driven by a lamp driver within the lamp drivers 48 according to the first output signal 118; a second lamp 148, adjacent the first lamp 146, that is driven by another lamp driver within the lamp drivers 48 according to the second output signal 120; a third lamp 150, adjacent the second lamp 148, that is driven by another lamp driver within the lamp drivers 48 according to the third output signal 122; and a fourth lamp 152, adjacent the third lamp 150, that is driven by another lamp driver within the lamp drivers 48 according to the fourth output signal 124. In this way, the lamps within each of the light arrangements 14, 16 are illuminated by pulses in a sequential manner, moving the illumination of the light units 146 from one of these units 146 to the next in a predetermined direction, with preferred directions of movement being indicated according to the placement of the light arrangements.

While the use of master/slave flip-flops to form a counter has been described, it is understood that such a circuit can readily be implemented with other types of devices, including various kinds of flip-flops triggered by rising or falling signal pulses.

Various numbers of lights may be used in this way. In general, the sequence in which the lamps are illuminated includes lighting each of the lamps or light units within a light arrangement 14, 16, extending in a direction of arrow 153 between a first lamp 146 with each lamp between a first lamp 146 and a last lamp 152 being illuminated after the lamp disposed adjacently opposite the direction of arrow 153 is illuminated and before the lamp disposed adjacently in the direction of arrow 153 is illuminated. For example, lamp 148 is illuminated after lamp 146 is illuminated and before lamp 150 is illuminated.

The individual lamps 46 may be of a number of different types, with the lamp drivers within the lamp drivers 48 being configured in manners well known to those skilled in the art of designing lighting circuits to drive the particular type of lamps being used. For example, the lamps 46 may be incandescent lamps or high-intensity LEDs (light emitting diodes). The lamps 46 may be electroluminescent panels, electrically driven in a manner described in U.S. Pat. No. 4,801,928, the disclosure of which is included herein by reference. Alternately, the lamps 46 may be conventional photo flash lamps of the discharge tube type, which are flashed on a periodic basis by means of an electrical charge built up within a capacitor within the lamp driver, as described in U.S. Pat. No. 4,442,069, the disclosure of which is additionally included herein by reference.

Figure 5:
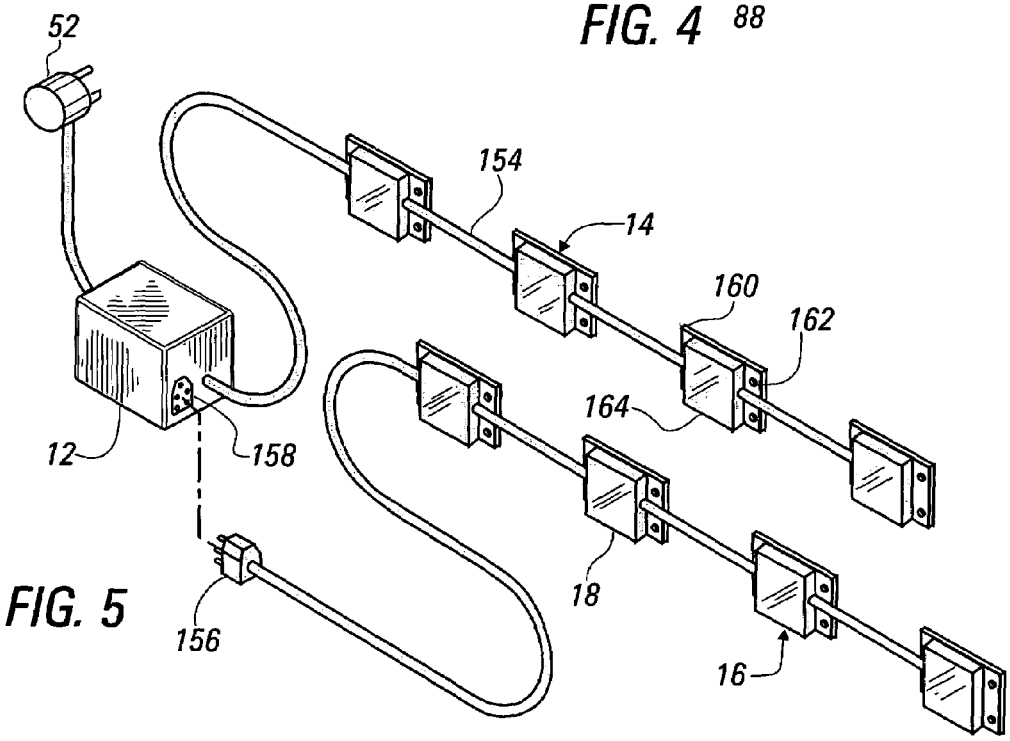
FIG. 5 is a perspective view of a device including flashing lights within the system of FIG. 1.

FIG. 5 is a perspective view of a control unit 12 with associated light arrangements 14, 16. In the example of this figure, each of the light arrangements includes four light units 18, arranged to extend along a flexible cable 154, which provides electrical signals driving the lamps 46 within the light units 14. A first light arrangement 14 is wired to extend from the control unit 12, while the second light arrangement 16 is removably attached to the control unit 12 by means of a plug 156 engaging a socket 158, being shown in an exploded relationship with the control unit 12. Each of the light units 14 includes a base portion 160 having one or more holes 162 for attachment to a wall surface and a transparent or translucent cover 164 through which the light from an internal lamp 46 shines. Such configurational details are shown only as examples. Two light arrangements may each be permanently wired to the control unit 12, or removably attached to the control unit through a plug and socket. There may be only one light arrangement attached to the control unit 12 or more than two such light arrangements. As few as two light units 18 may be used to indicate an exit direction, with the second unit 18 being flashed soon after the first, and with a significant time elapsing before the first light unit 18 is flashed again. Alternately, the number of light units 18 in a light arrangement may be greater than four. A directional icon, such as an arrow, may be printed on the surface of the cover 164, or an illuminated area having a shape of an arrow may be provided.

FIG. 6 is a block diagram of a fire protection system 170 configured in accordance with an alternative embodiment of the invention to provide indications of the safer direction between two possible directions of movement, by means of groups of flashing lights 172 that can be illuminated in either of two sequences. For each of the groups of flashing lights 172, the sequence in which the lights will be flashed is determined within a switching system 174 in response to determining the combination of alarm units 176 providing fire detection signals indicating that a fire condition has been detected. Each of the groups of flashing lights 172 is electrically operated by an associated control unit 178, with the flashing lights 172 and the control unit 178 together forming a switchable direction indicator 179. The alarm units 176 provide individual fire detection signals to the switching system 174 over a number of channels 180, which may be wired or wireless channels. Whenever such an alarm signal is received, the switching system 174 provides a signal over channels 182, which may be wired or wireless channels, to each of the control units 178, indicating the sequence in which the associated lights 172 lights are to be flashed.

FIG. 7 is a tabular view of the two sequences in which the lights 172 are flashed to indicate the two possible directions of movement. The first column 186 indicates the sequence in which signals are provided by a counter, such as the counter 44, which has been described in detail in reference to FIG. 3, to light the lights. The second column 188 indicates the first sequence in which the lights are flashed. In the given example of a system flashing four lights, the first output line from the counter, indicated as C1, flashes the first light, indicated as L1, before the second output line from the counter, indicated as C2 flashes the second light, indicated as L2. Next, the third output line, indicated as C3, flashes the third light, indicated as L3 before the fourth output line, indicated as C4, flashes the fourth light, indicated as L4. This portion of the sequence then repeats.

To provide an indication for movement in the opposite direction, the lights 172 are flashed in the second sequence of column 190, with the first output line, indicated as C1, flashing the first light, indicated as L1, before the second output line, indicated as C2, flashes the fourth light, indicated as L4. Then, the third output line, indicated as C3, flashes the third light, indicated as L3, before the fourth output line, indicated as C4, flashes the second light, indicated as L2. This portion of the sequence then repeats. Thus, in this example, the indicated direction is reversed by switching the effect of the signal on the second and fourth output lines from the counter 44 between the second and fourth lights with the signals from the first and third output lines being used in the same way within both sequences.

FIG. 8 is a schematic view of a direction indicator 179 including a control unit 178, within the fire protection system of FIG. 6, which is configured to produce either of the two sequences of FIG. 7 in response to input signals. Many of the elements of the control unit 178 are similar or identical to those of the control unit 12, which has been described in detail in reference to FIG. 2, and are therefore accorded like reference numbers. For example, if electrical power to the plug 52 is interrupted, the input terminal 72 is connected to the rechargeable battery 64 so that the pulse generator 42 begins producing pulses counted by the counter 44.

The control unit 178 includes a first input line 194, along which a first signal is received, indicating that the lights should be flashed in the first sequence to indicate movement in the first direction of arrow 153, and a second input line 196, along which a second signal is received, indicating that the lights should be flashed in the second sequence to indicate movement in a second direction, opposite the direction of arrow 153. If these inputs are transmitted along wireless channels, the input lines 194, 196 represent output lines from wireless receivers. If a signal is received on either of these input lines 194, 196, an output signal from OR gate 198 causes the relay driver 78 to drive current through the relay coil 80, closing contact 82 to start operation of the pulse generator 42. The counter 44 counts pulses from the pulse generator 42 as described above in reference to FIG. 3, providing output signals on lines 200, among which the signals of the second line 202 and the fourth line 204 are provided, along with the signals from input lines 194, 196, as inputs to a switching circuit 206. The electrical power required to operate the switching circuit 206 is provided through the rechargeable battery 64, so that this circuit can operate in the event of a failure of power supplying the plug 52.

If an input signal is not received on the second input line 196, an output is produced in the inverter 207, so that the second line 208 to the lamp drivers 48 is driven by the signal on the second output line 202 from the counter 44 through an AND gate 210 and an OR gate 212. Additionally, if an input signal not received on the second input line 196, the signal on the fourth line 214 is driven by the signal on the fourth output line 204 from the counter 44 through an AND gate 216 and through an OR gate 218. Thus, if the pulse generator 42 is operated due to a power failure or due to an input signal received on the first input line 194, the flashing lights 172 are driven to indicate movement in away from the control unit 178, in the direction of arrow 153.

On the other hand, if an input signal is received on the second input line 196, the second line 208 to the lamp drivers 48 is driven by the signal on the fourth output line 202 from the counter 44 through an AND gate 220 and the OR gate 212. Additionally, if an input signal is received on the second input line 196, the signal on the fourth line 214 is driven by the signal on the second output line 204 from the counter 44 through an AND gate 222 and through the OR gate 218. Thus, if the pulse generator 42 is operated due to an input signal received on the second input line 196, the flashing lights are driven to indicate movement toward the control unit 178, opposite the direction of arrow 153.

While the preceding discussion has covered switching the direction indicated by a lighting arrangement including four light units, it is understood that various numbers of lights can be used. In general, the second sequence is one in which each of the lamps or light units extending in the direction of arrow 153 between the first lamp 146 and the last lamp 152 is illuminated after the lamp disposed adjacently in the direction of arrow 153 is illuminated and before the lamp disposed adjacently opposite the direction of arrow 153 is illuminated. In general, the switching circuit 206 causes the lights to be flashed in the first or second sequence by switching one or more of the electrical connections through which electrical pulses are driven from the counter 44 to illuminate the lamps.

Each of the direction indicators 179 is preferably oriented within a building so that a direction of preferred movement in the event of a power failure is along the lights 172, away from the control unit 178, in the direction of arrow 153. In the event that fire conditions are detected, the switching system 174 causes the lights 172 to indicate movement in this direction of arrow 153 or opposite this direction, depending on the combination of alarm units 176 from which fire detection signals are received. Optionally, a second arrangement of lights 224 may be installed to extend in the same direction as the lights 172.

Figure 9:
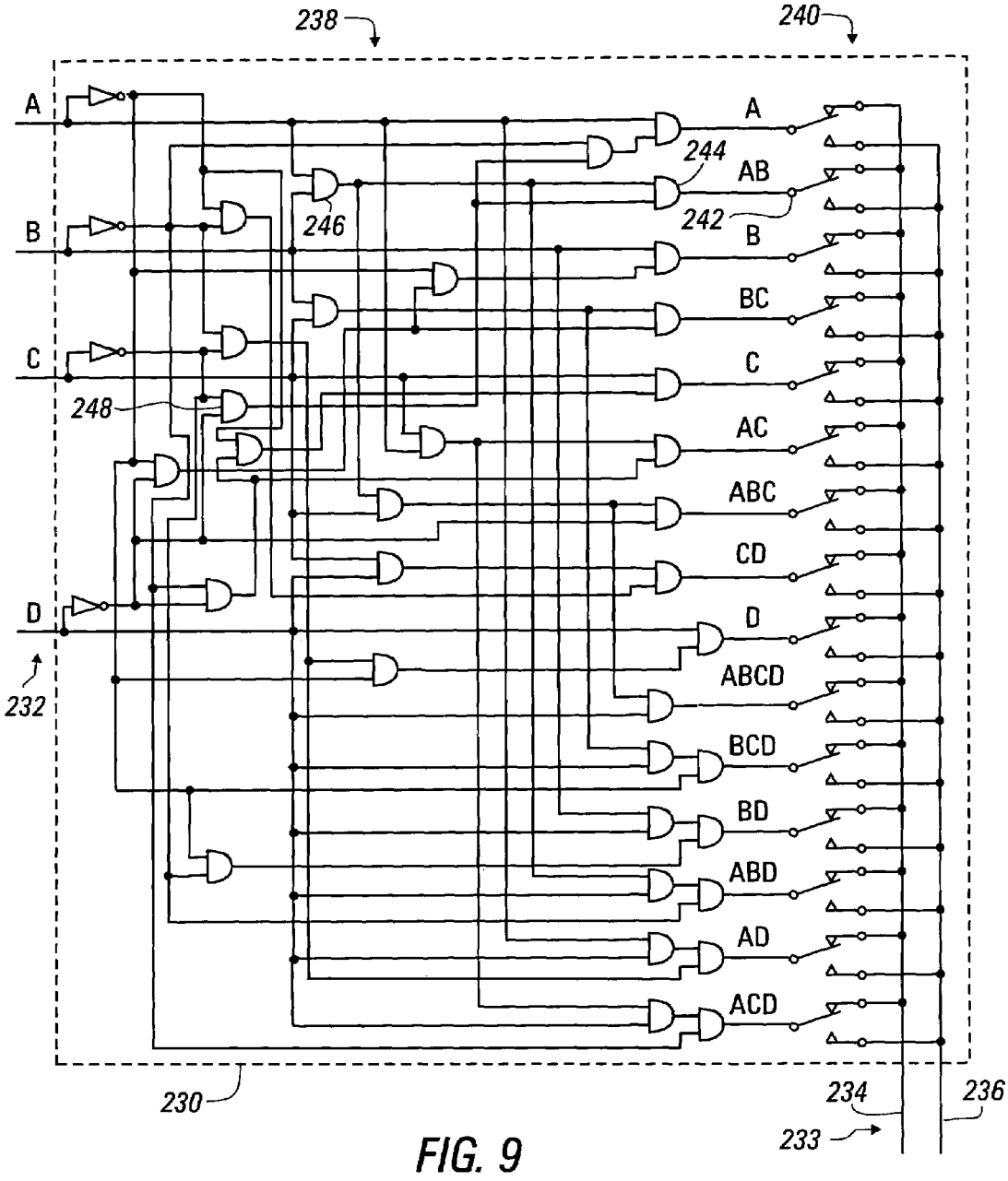
FIG. 9 is a schematic view of a switching unit within a first version of the fire protection system of FIG. 6.
Figure 10:
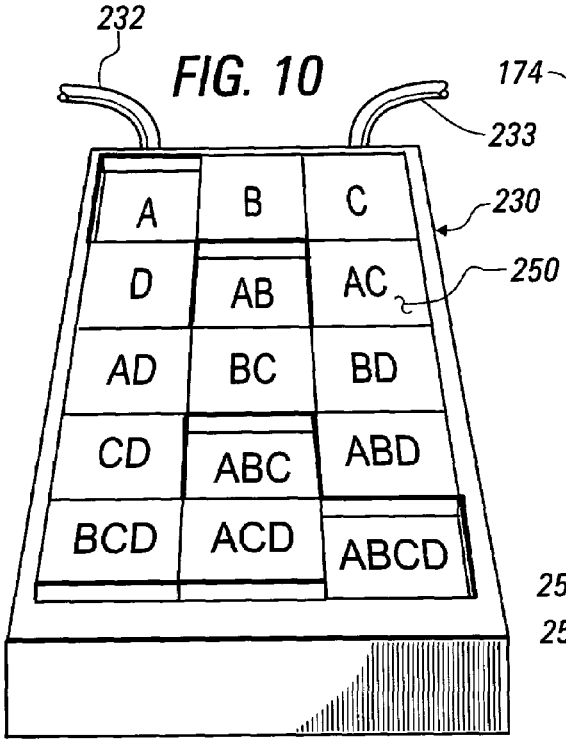
FIG. 10 is a perspective view of the switching unit of FIG. 9.

A first version of the switching system 174 within the system 170 of FIG. 6 will now be described, with reference being made to FIGS. 9 and 10, which show a switching unit 230 provided within the system 174 for each of the control units 178. FIG. 9 is a schematic view of the switching unit 230, while FIG. 10 is a perspective view thereof.

An input cable 232 provides signals, labeled A, B, C, and D, from each of the alarms 176 to the switching unit 230, in which these signals are used to generate a first output signal transmitted within an output cable 233 on an output line 234 and a second output signal transmitted on output line 236. The first signal causes the control unit 128 to flash lights indicating a first direction of motion, such as the direction away from the control unit 128, as indicated by arrow 153 in FIG. 8. The second signal causes the control unit 128 generate a second output signal transmitted on a second output line 236 to cause this control unit 128 to flash lights indicating a second direction of motion, such as the direction opposite to the arrow 153. The output lines 234, 236 of a switching unit 230 are connected to the input lines 194, 196, respectively, of an associated control unit 128 over wired or wireless channels.

Within the switching unit 230, a gate array 238 generates signals representing the various combinations of the input signals from the input cable 232 that can be present, with these generated signals being directed to the output lines 234, 236 through a array of switches 240. For example, if the A and B input signals are present without the C and D signals, a signal is provided to the transfer contact of a switch 242 through an AND gate 244, with an input to this AND gate 244 from an AND gate 246 providing a signal when the A and B fire detection signals are present, and with an input to this AND gate 244 from an AND gate 248 providing a signal when the C and D fire detection signals are not present.

The switches 240 are preferably each of a push—push type that remains in a down position upon being pushed once and that returns to an up position upon being pushed again. Each of the switches 240 is operated by a pushbutton 250 having a legend indicating the combination of active alarm units providing a signal to the particular switch associated with the pushbutton. Thus, when the fire protection system 170 is installed, the switches 240 of a switch unit 230 corresponding to each light unit, including a control unit 178 and lights 172, are actuated to indicate which combinations of fire detection signals indicate that the direction of motion indicated by the light sequence should be reduced from the direction indicated by arrow 153 in FIG. 8.

There is one switching unit 230 for each direction indicator 179. The number of switches 240, N, within the switching unit 230 is given by $$N=2^A-1$$

where A is the number of alarm units 176.

Figure 11:
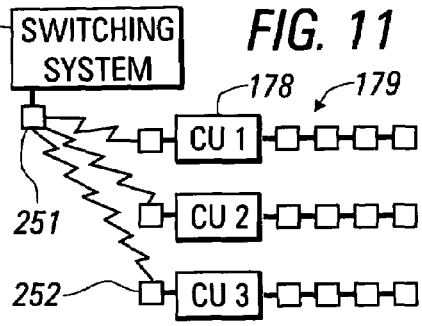
FIG. 11 is a block diagram of a version of the fire protection system of FIG. 6 having wireless communication between the switching system and direction indicators therein.

FIG. 11 is a block diagram of a version of the fire protection system 170 having wireless communication between the switching system 174 and the control units 178 of the direction indicators 179. The switching system 174 is connected to a transmitter 251, while each of the control units 178 is connected to a receiver 252. Wireless transmissions in the form of data embodied on a modulated carrier wave between the transmitter 251 and each of the receivers 252 cause the control units 178 to flash the lights in either of the two possible directions. For example, the receivers 252 are connected to the input lines 194, 196 described above in reference to FIG. 6.

Figure 12:
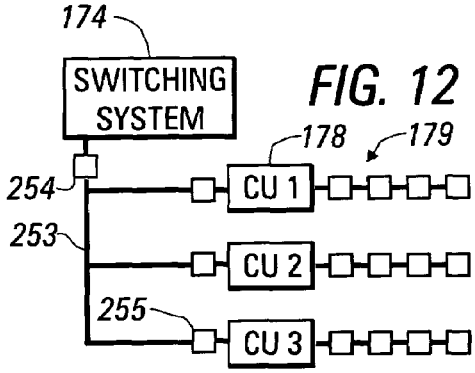
FIG. 12 is a block diagram of a version of the fire protection system of FIG. 6 having communication over a power wiring network between the switching system and direction indicators therein.

FIG. 12 is a block diagram of a version of the fire protection system 170 having communication between the switching system 174 and the control units 178 of the direction indicators 179 over the electrical power network 253 within the building. A transmission device 254, connected to the switching system 174, is inductively or capacitively coupled to the power network 253. A receiving device 255 connected to each of the control units is also inductively or capacitively coupled to the power network 253. Data causing each of the control units 178 to flash lights in either of the two possible directions is transmitted over the electrical power network 253 as embodied on a modulated carrier wave, through the plugs 52 (shown in FIG. 6) with which the control units 178 are attached to the main power network 256.

The methods of FIGS. 11 and 12 allow the direction indicators 179 to be easily installed, being connected to electrical energy by the plugs 52, without a need to install signal wires extending through the building. In general, the alarm signal transmitted from the switching system 174 is either an alarm signal of a first type, causing a particular direction indicator 179 to flash lights in the first sequence or a direction signal of a second type, causing the particular direction indicator 179 to flash lights in the second sequence. Such signals may be sent along separate wires, or they may be detected as being differently encoded, when they as sent over the same wire or wireless channel.

Figure 13:
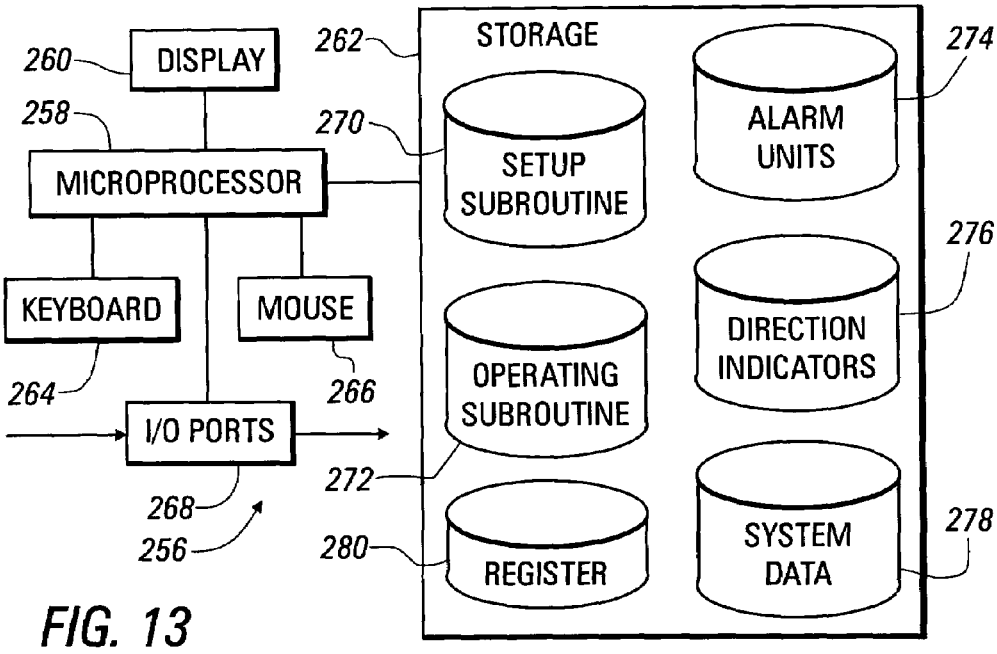
FIG. 13 is a block diagram of a computer system within a second version of the fire protection system of FIG. 6.

FIG. 13 is a block diagram of a computer system 256 within a second version of the switching system 174 of the fire protection system 170 of FIG. 6. The computer system 256 includes a number of conventional elements, such as a microprocessor 258, display unit 260, storage 262 for storing program instructions and data, a keyboard 264 for data entry, and a mouse 266 for providing user selections. The computer system additionally includes I/O (input/output)

port circuits 268, receiving signals from the alarm units 176 and transmitting signals to the control units 178. In accordance with this version of the invention, storage 262 stores program instructions to be executed within the microprocessor to run a setup subroutine 270 and an operating subroutine 272. Storage 262 then additionally stores an alarm data structure 274, a direction indicator data structure 276, a system data structure 278. Each of these data structures 274, 276, 278 is developed during execution of the setup subroutine 270, with the system data structure 278 then being used in the event of an alarm signal during the execution of the operating subroutine 272. Storage 262 also includes a register 280 storing latching bits used to control the operation of the various direction indicators 179 during execution of the operating subroutine 272.

Figure 14:
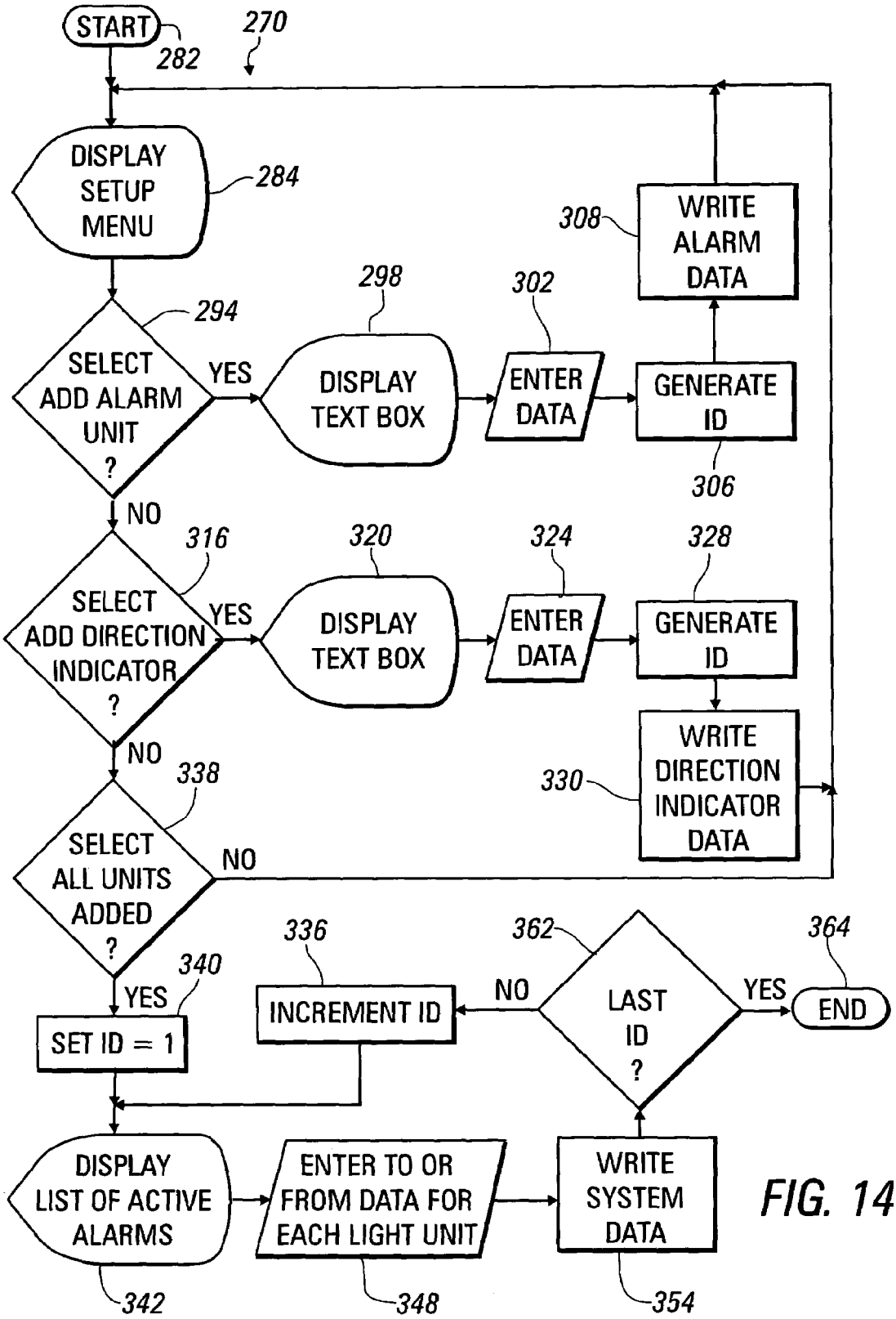
FIG. 14 is a flow chart of process steps occurring during execution of a setup subroutine within the computer system of FIG. 13.

FIG. 14 is a flow chart of process steps occurring during execution of the setup subroutine 270, in which a user interface is provided for specifying the direction of motion to be indicated by the lights 172 within each direction indicator 179 for each possible combination of signals from alarm units 176. After starting in step 272, the setup subroutine 270 proceeds to step 284, in which a setup menu is displayed on the display screen 270.

FIG. 15 is a display view of the setup menu 286, which includes three command buttons 288, 290, 292, which are individually selected by moving a cursor on the display screen 270 using a pointing device, such as the mouse 266.

Following step 284, when a determination is made in step 294 that the first command button 288 has been selected to add an alarm unit 176 to the alarm unit data structure 274, a text box for adding an alarm unit is displayed in step 298.

FIG. 16 is a display view of the text box 296 for adding data describing an alarm unit 176. The text box 296 includes a field 300 in which data entered by the user through the keyboard 264 is displayed. In step 302, the user enters a name for the alarm unit being added in this way. Conventional user interface capabilities may be additionally provided, with corrections being applied through the use of the backspace key of the keyboard 264 or with the data displayed within the field 300 being highlighted when it is selected before it is replaced with data from the keyboard 264. When the user has finished entering data in the field 300, he selects the add command button 304 to end the data entry step 302. Then, in step 306, the setup subroutine 270 generates a new identification number for the alarm unit 176 being added. Next, in step 308, data is written to the alarm unit data structure 274, with the setup subroutine 270 then returning to step 284 to display the setup menu 286.

FIG. 17 is a pictographic view of the alarm unit data structure 274, which includes a data record 310 for each of the alarm units 176. An identifier data field 312 stores a binary number identifying the alarm unit 176 associated with each of the data records 310, while a name data field 314 stores the name provided by the user in step 302. A new data record 310 is added to the alarm unit data structure 274 each time alarm data is written in step 308. Each of the identifiers in the identified data field 312 is generated in step 306 as a different binary number having a value of one in a single position, with the other positions being filled with values of zero, providing a structure allowing the identifiers to be added to represent various combinations of alarm units producing fire detection signals.

Referring again to FIG. 15, if it is determined in step 294 that the add alarm unit command button 288 has not been selected, the setup subroutine 270 proceeds to step 316, in which a further determination is made of whether the add direction indicator command button 290 has been selected to provide for the addition of data for direction indicator 179.

FIG. 18 is a display view of a text box 318 for adding data describing a direction indicator 179. The text box 318, which is displayed in step 320 following a determination in step 316 that the command button 290 has been selected, includes a field 322 in which data entered by the user through the keyboard 264 is displayed. In step 324, the user enters a name for the direction indicator 179 being added in this way. Conventional user interface capabilities, as described above in reference to the entry of data in the field 300 of FIG. 16, are preferably also provided for the entry of data in field 322. When the user has finished entering this data, he selects the add command button 326, ending the data entry step 324. Then, the setup subroutine 270 proceeds to step 328, in which a identifier is generated, and to step 330, in which a data is written to the direction indicator data structure 276 before returning to step 284 to display the setup menu 286.

FIG. 19 is a pictographic view of the direction indicator data structure 276, which includes a data record 332 for each of the direction indicators 179. An identifier data field 334 stores a binary number identifying the direction indicator 179 for which data is stored in the data record 332. The direction indicators 179 may simply be sequential binary numbers. A name data field 336 stores the name provided by the user in step 324. A new data record 332 is added to the direction indicator data structure 276 every time data is written in step 330.

If it is determined in step 316 that the add direction indicator command button 290 has not been selected, the setup subroutine 270 proceeds to step 338, in which a further determination is made of whether the all units added command button 292 has been selected to indicate that there are no more alarm units 176 and no more direction indicators 179 for which data is to be added. If it is determined that this command button 292 has not been selected, the system returns to step 284 to continue displaying the setup menu 286. On the other hand, if it is determined in step 338 that the command button 292 has been selected, the setup subroutine 270 proceeds to step 340, in which an identifier variable associated with the alarm units 176 is set to a value of one. Next, in step 342, an activated alarms list box is displayed.

FIG. 20 is a display view of the activated alarms list box 344, which is displayed in step 342 to provide a list 346 of the alarm units corresponding to the value of the identifier variable. This list box 344 additionally includes a field 347 identifying one of the direction indicators 179. The names provided by the user and stored in name fields 314, 326, as described above in reference to FIGS. 15 and 17, are used for this purpose. Then, in step 348, the user selects the from command button 350 or the to command button 352 to indicate whether the direction indicator 179 identified in the field 347 should indicate movement away from its control unit 178, in the direction of arrow 153 (shown in FIG. 8) or to its control unit 178, opposite the direction of arrow 153. After this selection has been made, the setup subroutine 270 displays the next direction indicator 179 in the field 347, for a similar selection to be made using the command buttons 350, 352. In this way, each of the direction indicators 179 listed within the direction indicator data structure 276 is prevented for such a selection. When this process is completed, the data entry step 348 is finished, so the setup subroutine 270 proceeds to step 354, in which data is written to the system data structure 278.

FIG. 21 is a pictographic view of the system data structure 278, which includes a data record 356 for each combination of alarm units 176. An identifier field 358 stores a binary number for each such combination, with each position having a one value indicating the presence of an alarm signal from the alarm unit 176 having a one value in a corresponding position within the identifier data field 312 of the alarm unit data structure 274. Each position within the number in the identifier field 358 having a zero value indicate that the corresponding alarm unit 176 is not producing an alarm signal in the combination of alarm units of the data record 356. A direction field 360 for each of the direction indicators 179 indicates the direction established by the user through the selection of command buttons 350, 352 in step 348 for the particular combination of alarm units described in the identifier field 358 of the data record 356. The number of data records 356, N, is given by $$N=2^A-1,$$

where A is the number of alarm units 176.

After writing data to a new data record 356 in step 345, the setup subroutine 270 proceeds to step 362, in which a determination is made of whether the identifier of the data record 356 is the last possible identifier, such as a binary number having a one value in each position. If it is, the setup subroutine ends in step 364. If it is not, this identifier is incremented in step 366, for example, by adding one to the number, and the subroutine returns to step 342 to receive user input data for the combination of alarm units described by the new identifier.

Figure 22:
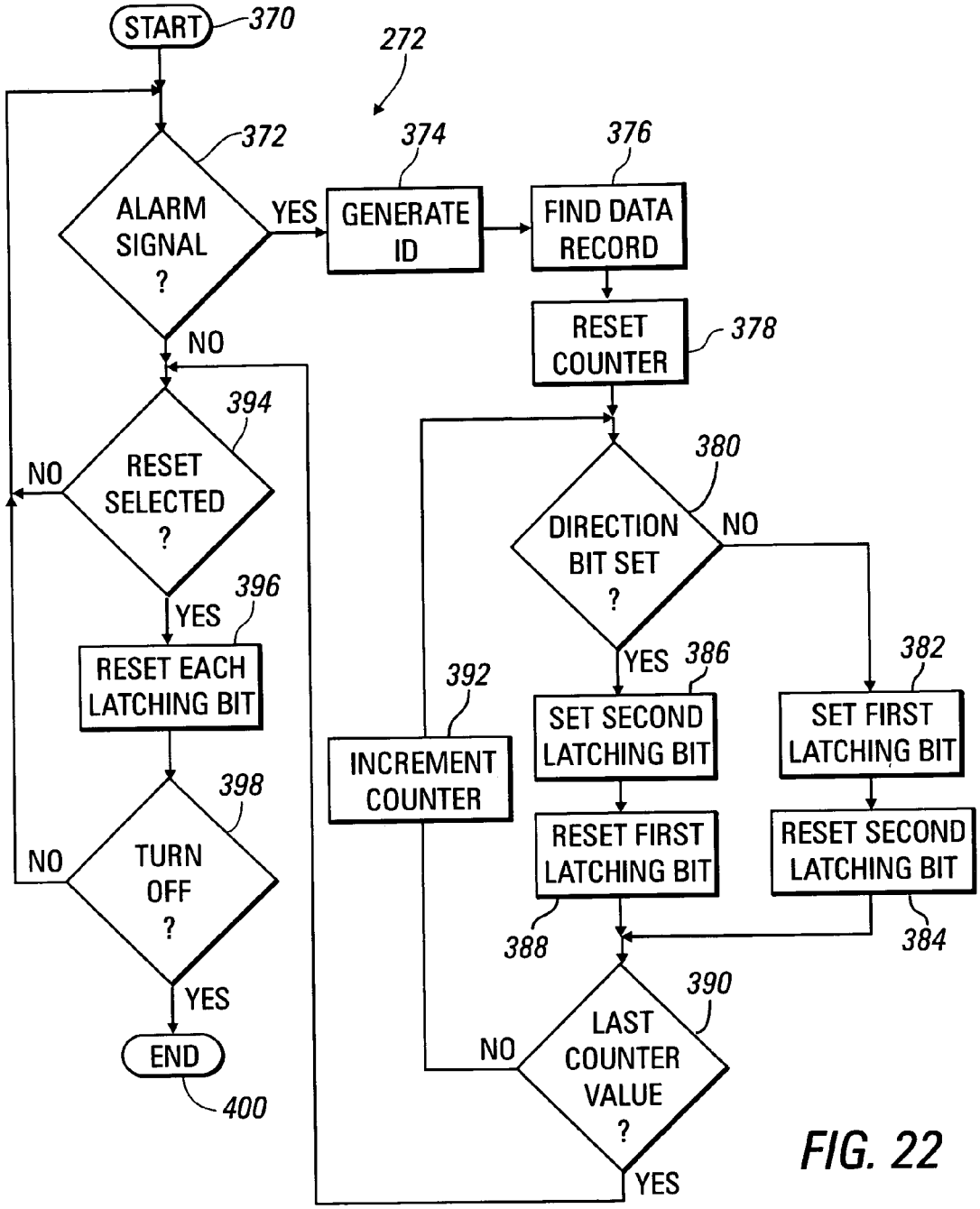
FIG. 22 is a flow chart occurring the execution of a operating subroutine in the computer system of FIG. 13.

FIG. 22 is a flow chart showing processes occurring during execution of the operating subroutine 272, which may be started automatically or by another selection process or by launching an application after the completion of the setup subroutine 272. After starting in step 370, the operating subroutine 272 proceeds to step 372, in which a determination is made of whether an alarm signal is being received from one of the alarm units 176. If it is, an identifier is generated in step 374, as a binary number in the form of the numbers stored in the identifier field 368 of the system data structure 278, with each position representing an alarm unit 176 having a one value and with each other position having a zero value. Then, in step 276 a data record 356 within the system data structure 278 is found having an identifier in the identifier field 278 matching the identifier generated in step 374.

Next, in step 378, a counter used to step among the direction fields 360 of the system data structure 278 is reset, so that data from the first of the direction fields 360 will be read. In step 380, a determination is made of whether the direction bit is set in the data record found in step 376 within the direction field 360 determined by the counter. If this bit is not set, a first latching bit within the register 280 corresponding to the direction indicator 178 associated with the direction field 360 is set in step 382, and the second latching bit corresponding to this direction indicator 178 is reset in step 384. Setting the first latching bit causes a signal to be continuously transmitted from the I/O ports 268 of the computer system 256 to the direction indicator 179 associated with the direction field 360 causing the light arrangement 172 to indicate a direction extending away from the control unit, in the direction of arrow 153. On the other hand, if it is determined in step 380 that the direction bit is set, the second latching bit is set in step 386, and the first latching bit is reset in step 388. Setting the second latching bit causes a signal to be continuously transmitted from the I/O ports 268 to this direction indicator 179 causing the lights arrangement 172 to indicate a direction extending toward the control unit, opposite the direction of arrow 153. Then, in step 390, a determination is made of whether the counter value represents the last counter value, indicating that each of the direction fields 360 has been examined. If it is not the last counter value, the counter value is incremented in step 392, with the operating subroutine 272 then returning to step 380 to set the first or second latching bit for the direction indicator 179 associated with the next data field 360.

If it is determined in step 390 that the counter value is the last counter value, the operating subroutine 272 proceeds to step 394, in which it is determined whether a reset function has been selected. A reset function may be provided through the depression of a keyboard key or through the selection of a displayed command button, allowing the user to stop the flashing lights by resetting each of the latching bits in step 396. The subroutine 272 does not reset latching bits automatically when an alarm signal from an alarm unit 176 is stopped, because the signal may have been stopped due to the destruction of the alarm device 176 in a fire. Since the alarm process will start again after the latching bits are reset if the alarm signal continues to be present, a further facility for manually stopping the operating subroutine 272 in the event that the alarm has been determined to be false. Thus, after the latching bits have been reset, a further determination is made in step 398 of whether the operating subroutine 272 has been stopped. If it has been stopped, the subroutine 272 ends in step 400.

If it is determined in step 398 that the reset function has not been selected, or if it is determined in step 398 that the operating subroutine 272 has not been stopped, this subroutine 272 returns to step 380. While changes in the fire detection signals being received are not allowed to stop the process of flashing lights, such changes are preferably allowed to initiate changes in the directions being indicated, since such changes may indicate changes in the preferred directions of escape due to changing fire conditions. When one of the latching bits for a particular direction indicator 179 is set, the other latching bit for this direction indicator 179 is reset, with the understanding that applying a reset signal to a latching bit that is already in a reset condition has no effect.

While the preceding discussions in reference to FIGS. 6–22 have focused on a fire protection system 170 including four alarm units 176 and three direction indicators 179, each of which can be caused to indicate either of two directions in response to the combination of the alarm units 176 providing fire detection signals, it is understood that this description has been given only by way of example. It may not be necessary to provide each of the direction indicators 179 with the ability to indicate both directions. For example, only one centrally located direction indicator 179 may be provided with this ability in accordance with a version of the invention, with other direction indicators 179 always directing movement toward the nearest exit, regardless of the combination of alarm units 176 transmitting fire detection signals. If a switching unit 230, as described above in reference to FIGS. 9 and 10, is used, only one such unit is required for each of the direction indicators 179 that can be used to indicate either of two directions. If the computer system 256 is used, as described above in reference to FIGS. 13–22, the system data structure 278 requires only one data field 360 for each of the direction indicators 179 that can be used to indicate either of the two directions; the first type of alarm signal can be generated to each of the other direction indicators 179 whenever a fire detection signal is received.

While the invention has been described in its preferred forms or embodiments with some degree of particularity, it is understood that this description has been given only by way of example, and that many variations can be made without departing from the spirit and scope of the invention, as described in the appended claims.

What is claimed is:

1. Apparatus comprising:

a first arrangement of light units including a first plurality of electrically interconnected light units, each including a lamp, with the first plurality of light units extending in a first direction from a first light unit at a first end of the first plurality of light units to a last light unit and an end of the first plurality of light units opposite the first end; and a control unit including a battery, a plug for attachment to an external electrical power source, a first switching circuit, and a lamp circuit, electrically connected to the first arrangement of light units and additionally electrically connected to the battery by the first switching circuit in response to termination of a flow of electrical current through the plug from the external electrical power source, to illuminate all light units within the first plurality in a first sequence, wherein each light unit disposed between the first light unit and the last light unit is illuminated after a light unit adjacently disposed opposite the first direction is illuminated and before a light unit adjacently disposed in the first direction is illuminated.

2. The apparatus of claim 1, wherein the first switching circuit additionally connects a terminal of the battery to provide battery charging with current from the external electrical power source while current is flowing through the plug from the external electrical power source.

3. The apparatus of claim 1, wherein the lamp circuit includes:

a pulse generator providing an output signal including a sequence of pulses during operation of the lamp circuit; and a counter counting pulses within the output signal from the pulse generator and sequentially driving electrical pulses through electrical connections to illuminate the lamps within the light units in response to the pulses within the output signal from the pulse generator.

4. The apparatus of claim 1, wherein the lamp circuit illuminates the light units in the sequence in response to termination of the flow of current through the plug from the external power source repeatedly until current begins to flow through the plug from the external power source.

5. The apparatus of claim 1, wherein the control unit additionally comprises a cable connector, the apparatus additionally comprises a second arrangement of light units including a second plurality of electrically interconnected light units, each including a lamp, with the second plurality of light units extending in a second direction from a first light unit at a first end of the second plurality of light units to a last light unit and an end of the second plurality of light units opposite the first end, and the lamp circuit is additionally electrically connected to the second arrangement of light units to illuminate all light units within the second plurality in a sequence, wherein each light unit disposed between the first light unit and the last light unit is illuminated after a light unit adjacently disposed opposite the first direction is illuminated and before a light unit adjacently disposed in the first direction is illuminated.

6. The apparatus of claim 1, wherein the lamp circuit additionally includes a second switching circuit connecting the lamp circuit to a source of electrical current in response to a first external fire detection signal.

7. The apparatus of claim 6, wherein the lamp circuit is additionally connected to the source of electrical current in response to a second external fire detection signal, and the lamp circuit additionally includes a third switching circuit causing all light units within the first plurality in a second sequence, wherein each light unit disposed between the first light unit and the last light unit is illuminated after a light unit adjacently disposed in the first direction is illuminated and before a light unit adjacently disposed opposite the first direction is illuminated.

8. The apparatus of claim 7, wherein the lamp circuit includes a pulse generator providing an output signal including a sequence of pulses during operation of the lamp circuit, and a counter counting pulses within the output signal from the pulse generator and sequentially driving electrical pulses through electrical connections to illuminate the lamps within the light units in response to the pulses within the output signal from the pulse generator, and the third switching circuit switches at least one of the electrical connections through which electrical pulses are sequentially driven from the counter to illuminate the lamps within the light units in the second sequence.

9. Apparatus comprising:

a first arrangement of light units including a first plurality of electrically interconnected light units, each including a lamp, with the first plurality of light units extending in a first direction from a first light unit at a first end of the first plurality of light units to a last light unit and an end of the first plurality of light units opposite the first end; and a control unit including input lines for receiving first and second fire detection signals and a lamp circuit driving all lamps within the first arrangement of light units in a first sequence in response to receiving the first fire detection signal, wherein each light unit disposed between the first light unit and the last light unit is illuminated after a light unit adjacently disposed opposite the first direction is illuminated and before a light unit adjacently disposed in the first direction is illuminate, and in a second sequence in response to receiving the second fire detection signal, wherein each light unit disposed between the first light unit and the last light unit is illuminated after a light unit adjacently disposed in the first direction is illuminated and before a light unit adjacently disposed opposite the first direction is illuminated.

10. The apparatus of claim 9, wherein the lamp circuit includes:

a pulse generator providing an output signal including a sequence of pulses during operation of the lamp circuit;

a counter counting pulses within the output signal from the pulse generator and sequentially driving electrical pulses through electrical connections to illuminate the lamps within the light units in response to the pulses within the output signal from the pulse generator; and a switching circuit switching at least one of the electrical connections through which electrical pulses are sequentially driven from the counter to illuminate the lamps within the light units in the second sequence.

11. The apparatus of claim 9, wherein the control unit additionally includes:

a battery;

a plug for attachment to an external electrical power source; and a switching circuit electrically connecting the battery to lamp circuit to the battery to drive all lamps within the first arrangement of light units in the first sequence in response to termination of a flow of electrical current through the plug.

12. The apparatus of claim 9, wherein the control unit additionally comprises a cable connector, the apparatus additionally comprises a second arrangement of light units including a second plurality of electrically interconnected light units, each including a lamp, with the second plurality of light units extending in a second direction from a first light unit at a first end of the second plurality of light units to a last light unit and an end of the second plurality of light units opposite the first end, and the lamp circuit is additionally electrically connected to the second arrangement of light units to illuminate all light units within the second plurality in a sequence, wherein each light unit disposed between the first light unit and the last light unit is illuminated after a light unit adjacently disposed opposite the first direction is illuminated and before a light unit adjacently disposed in the first direction is illuminated.

13. A system comprising:

a plurality of arrangements of light units, wherein each of the arrangements of light units includes a first plurality of electrically interconnected light units, each including a lamp, with the first plurality of light units extending in a first direction from a first light unit at a first end of the first plurality of light units to a last light unit and an end of the first plurality of light units opposite the first end, and a plurality of control units, each including a battery, a plug attached to an external electrical power source, a first switching circuit, and a lamp circuit, electrically connected to at least one of the arrangements of light units and additionally electrically connected to the battery by the first switching circuit in response to termination of a flow of electrical current through the plug from the external electrical power source, to illuminate all light units within the first plurality in a first sequence, wherein each light unit disposed between the first light unit and the last light unit is illuminated after a light unit adjacently disposed opposite the first direction is illuminated and before a light unit adjacently disposed in the first direction is illuminated.

14. The system of claim 13, wherein the first switching circuit additionally connects a terminal of the battery to provide battery charging with current from the external electrical power source while current is flowing through the plug from the external electrical power source.

15. The system of claim 13, additionally comprising an alarm unit producing a fire detection signal in response to detecting a fire condition and a channel transmitting the first fire detection signal from the alarm unit to each of the control units, wherein the lamp circuit additionally includes a second switching circuit connecting the lamp circuit to a source of electrical current in response to receiving the first fire detection signal from the channel.

16. The system of claim 13, additionally comprising a plurality of alarm units producing a fire detection signal in response to detecting a fire condition;

a switching system receiving the fire detection signals from the plurality of alarm units and transmitting alarm signals to the control units within the plurality of control units; wherein the alarm signal transmitted to at least one of the control units is of a first type or of a second type depending on a combination of the control units producing the fire detection signals, wherein within each of the control units, the lamp circuit is connected to a source of electrical current to illuminate all light units within the first plurality in the first sequence in response to receiving a control signal of the first type, wherein within each of the control units, the lamp circuit is connected to the source of electrical current to illuminate all light units within the first plurality in a second sequence in response to receiving an alarm signal of the second type, and wherein when the light units are illuminated in the second sequence, each light unit disposed between the first light unit and the last light unit is illuminated after a light unit adjacent disposed in the first direction is illuminated and before a light unit adjacently disposed opposite the first direction is illuminated.

17. The system of claim 16, wherein the switching system includes at least one switching unit having:

an input terminal for receiving a fire detection signal from each of the alarm units;

a circuit generating a switch input signal corresponding to each combination within a plurality of combinations of fire detection signals; and a plurality of switches, each connected to receive one of the switch input signals, each switchable between a first position and a second position, wherein an input signal of the first type is generated for transmission to a control unit from a switch input signal with the switch in the first portion, and wherein an input signal of the second type is generated for transmission to the control unit from a switch input signal with the switch in the second position.

18. The system of claim 16, wherein the switching system includes a computer system including:

at least one input port receiving fire detection signals from a plurality of alarm units;

at least one output port transmitting an alarm signal to at least one of the control units;

storage storing a data structure including a data record for each combination of the alarm units in a plurality of combinations of the alarm units, wherein each of the data records includes a code for at least one of the control units indicating whether an alarm signal of a first type or an alarm signal of a second type is to be sent to the control unit;

a microprocessor programmed to perform steps of:

receiving a fire detection signal from at least one of the alarm units;

finding a data record in the data structure corresponding to a combination of the alarm units transmitting the fire detection signal;

transmitting the alarm signal of the first type to at least one of the control units in response to finding a code in the data record indicating that the alarm signal of the first type is to be transmitted to the control unit; and transmitting the alarm signal of the second type to at least one of the control units in response to finding a code in the data record indicating that the alarm signal of the second type is to be transmitted to the control unit.

19. The system of claim 16, wherein the switching system includes a computer system including:

at least one input port receiving fire detection signals from a plurality of alarm units;

at least one output port transmitting an alarm signal to at least one of the control units;

storage;

a selection device for providing user inputs; and a microprocessor programmed to perform a setup subroutine and an operating subroutine, wherein the setup subroutine includes receiving user inputs from the selection device for at least one combination of the alarm units and for at least one of the control units indicating whether the alarm signal of the first type or of the second type is to be transmitted to the control unit, and writing a data record within a data structure in the storage for each of the at least one combination of alarm units including a code indicating for each of the at least one of the control units whether the alarm signal of the first type or of the second type is to be transmitted to the control unit, and the operating subroutine includes receiving a fire detection signal from at least one of the alarm units; finding a data record in the data structure corresponding to a combination of the alarm units transmitting the fire detection signal; transmitting the alarm signal of the first type to at least one of the control units in response to finding a code in the data record indicating that the alarm signal of the first type is to be transmitted to the control unit; and transmitting the alarm signal of the second type to at least one of the control units in response to finding a code in the data record indicating that the alarm signal of the second type is to be transmitted to the control unit.

20. A system comprising:

a plurality of alarm units producing a fire detection signal in response to detecting a fire condition;

a plurality of arrangements of light units, wherein each of the arrangements of light units includes a first plurality of electrically interconnected light units, each including a lamp, with the first plurality of light units extending in a first direction from a first light unit at a first end of the first plurality of light units to a last light unit and an end of the first plurality of light units opposite the first end;

a plurality of control units, each including a circuit illuminating all light units within the first plurality in a first sequence in response to an alarm signal of a first type, wherein, in the first sequence, each light unit disposed between the first light unit and the last light unit is illuminated after a light unit adjacently disposed opposite the first direction is illuminated and before a light unit adjacently disposed in the first direction is illuminated, wherein the circuit within at least one of the control units additionally illuminates all light units within the first plurality in a second sequence in response to an alarm signal of a second type, wherein, in the second sequence, each light unit disposed between the first light unit and the last light unit is illuminated after a light unit adjacently disposed in the first direction is illuminated and before a light unit adjacently disposed opposite the first direction is illuminated;

a switching system receiving the fire detection signals from the plurality of alarm units and transmitting alarm signals to the control units within the plurality of control units; wherein the alarm signal transmitted to at least one of the control units is of the first type or of the second type depending on a combination of the control units producing the fire detection signals.

21. The system of claim 20, wherein the switching system includes at least one switching unit having:

an input terminal for receiving a fire detection signal from each of the alarm units;

a circuit generating a switch input signal corresponding to each combination within a plurality of combinations of fire detection signals; and a plurality of switches, each connected to receive one of the switch input signals, each switchable between a first position and a second position, wherein an input signal of the first type is generated for transmission to a control unit from a switch input signal with the switch in the first portion, and wherein an input signal of the second type is generated for transmission to the control unit from a switch input signal with the switch in the second position.

22. The system of claim 20, wherein the switching system includes a computer system including:

at least one input port receiving fire detection signals from a plurality of alarm units;

at least one output port transmitting an alarm signal to at least one of the control units;

storage storing a data structure including a data record for each combination of the alarm units in a plurality of combinations of the alarm units, wherein each of the data records includes a code for at least one of the control units indicating whether an alarm signal of a first type or an alarm signal of a second type is to be sent to the control unit;

a microprocessor programmed to perform steps of:

receiving a fire detection signal from at least one of the alarm units;

finding a data record in the data structure corresponding to a combination of the alarm units transmitting the fire detection signal;

transmitting the alarm signal of the first type to at least one of the control units in response to finding a code in the data record indicating that the alarm signal of the first type is to be transmitted to the control unit; and transmitting the alarm signal of the second type to at least one of the control units in response to finding a code in the data record indicating that the alarm signal of the second type is to be transmitted to the control unit.

23. The system of claim 20, wherein the switching system includes a computer system including:

at least one input port receiving fire detection signals from a plurality of alarm units;

at least one output port transmitting an alarm signal to at least one of the control units;

storage;

a selection device for providing user inputs; and a microprocessor programmed to perform a setup subroutine and an operating subroutine, wherein the setup subroutine includes receiving user inputs from the selection device for at least one combination of the alarm units and for at least one of the control units indicating whether the alarm signal of the first type or of the second type is to be transmitted to the control unit, and writing a data record within a data structure in the storage for each of the at least one combination of alarm units including a code indicating for each of the at least one of the control units whether the alarm signal of the first type or of the second type is to be transmitted to the control unit, and the operating subroutine includes receiving a fire detection signal from at least one of the alarm units; finding a data record in the data structure corresponding to a combination of the alarm units transmitting the fire detection signal; transmitting the alarm signal of the first type to at least one of the control units in response to finding a code in the data record indicating that the alarm signal of the first type is to be transmitted to the control unit; and transmitting the alarm signal of the second type to at least one of the control units in response to finding a code in the data record indicating that the alarm signal of the second type is to be transmitted to the control unit.

24. The system of claim 20, wherein the alarm signal is transmitted as embodied on a modulated carrier wave.

25. The system of claim 24, wherein the alarm signal is transmitted over a portion of an electrical power network.

* * * * *